US007935038B2

(12) United States Patent
Tyree

(10) Patent No.: US 7,935,038 B2
(45) Date of Patent: May 3, 2011

(54) EXERCISE MACHINE WITH MANUALLY OPERATED PIVOTING ROCKER AND WITH COUNTERBALANCE ARM CONFIGURABLE TO ASSIST OR OPPOSE MOVEMENT OF ROCKER

(76) Inventor: Timothy Tyree, Scottsdale, AZ (US)

( * ) Notice: Subject to any disclaimer, the term of this patent is extended or adjusted under 35 U.S.C. 154(b) by 0 days.

(21) Appl. No.: 11/811,917

(22) Filed: Jun. 12, 2007

(65) Prior Publication Data

US 2008/0058172 A1 Mar. 6, 2008

Related U.S. Application Data

(60) Continuation-in-part of application No. 11/478,853, filed on Jul. 3, 2006, now abandoned, which is a division of application No. 10/211,553, filed on Aug. 5, 2002, now Pat. No. 7,229,394, and a continuation-in-part of application No. 11/702,937, filed on Feb. 6, 2007, now abandoned, which is a continuation of application No. 10/211,553, filed on Aug. 5, 2002, now Pat. No. 7,229,394.

(51) Int. Cl.
*A63B 21/00* (2006.01)

(52) U.S. Cl. ..... 482/137

(58) Field of Classification Search ..... 482/129, 482/137, 92–100, 142, 139
See application file for complete search history.

(56) References Cited

U.S. PATENT DOCUMENTS

| | | | | |
|---|---|---|---|---|
| 4,468,026 | A | 8/1984 | Roark | |
| 4,575,077 | A | 3/1986 | Osborne et al. | |
| 4,725,056 | A | 2/1988 | Rehrl et al. | |
| 5,058,884 | A | 10/1991 | Fuller | |
| 5,094,450 | A | 3/1992 | Stearns | |
| 5,158,520 | A | 10/1992 | Lemke et al. | |
| 5,334,120 | A | 8/1994 | Rasmussen | |
| 5,499,962 | A | 3/1996 | Jones | |
| 5,569,133 | A | 10/1996 | Vittone | |
| 5,628,714 | A | 5/1997 | Philipson | |
| 5,634,873 | A | 6/1997 | Carlstrom | |
| 5,711,749 | A | 1/1998 | Miller | |
| 5,766,118 | A | 6/1998 | Conner | |
| 6,059,698 | A | 5/2000 | Mazor | |
| 6,059,701 | A * | 5/2000 | George et al. | 482/137 |
| 6,106,444 | A | 8/2000 | Maingart | |
| 6,231,486 | B1 | 5/2001 | Lee | |
| 6,296,594 | B1 | 10/2001 | Simonson | |
| 7,229,394 | B1 | 6/2007 | Tyree | |
| 2004/0209745 | A1 * | 10/2004 | Riney et al. | 482/97 |

* cited by examiner

*Primary Examiner* — Lori Baker
(74) *Attorney, Agent, or Firm* — Tod R. Nissle, P.C.

(57) ABSTRACT

An exercise machine includes a rocker and a weight bearing frame pivotally interconnected with the rocker. The rocker and weight bearing frame are each pivotally mounted on a support frame or base. The weight bearing frame opposes movement of the rocker when the rocker moves in one direction and assists movement of the rocker when the rocker moves in another direction. The rocker can move from an upright orientation to a second orientation in which the rocker is canted below horizontal.

1 Claim, 13 Drawing Sheets

EXERCISE MACHINE WITH MANUALLY OPERATED PIVOTING ROCKER AND WITH COUNTERBALANCE ARM CONFIGURABLE TO ASSIST OR OPPOSE MOVEMENT OF ROCKER

This application is (1) a continuation-in-part of U.S. patent application Ser. No. 11/478,853, filed Jul. 3, 2006 now abandoned, which is a division of U.S. patent application Ser. No. 10/211,553, filed Aug. 5, 2002 now U.S. Pat. No. 7,229,394, and (2) a continuation-in-part of U.S. patent application Ser. No. 11/702,937, filed Feb. 6, 2007 now abandoned, which is a continuation of U.S. patent application Ser. No. 10/211,553, filed Aug. 5, 2002 now U.S. Pat. No. 7,229,394.

CROSS-REFERENCE TO RELATED APPLICATIONS

Application Ser. No. 11/811,918, filed Jun. 12, 2007.

STATEMENT REGARDING FEDERALLY SPONSORED RESEARCH ON DEVELOPMENT

N/A

THE NAMES OF THE PARTIES TO A JOINT RESEARCH AGREEMENT

N/A

INCORPORATION-BY-REFERENCE OF MATERIAL SUBMITTED ON A COMPACT DISC

N/A

SEQUENCE LISTING

N/A

BACKGROUND OF THE INVENTION (1) Field of the Invention

The present invention relates in general to exercise equipment, and in particular to such equipment which is used primarily to exercise leg muscles.

(2) Description of Related Art Including Information Disclosed Under 37 CFR 1.97 and 1.98

The need for physical exercise and conditioning is well known, especially in a culture where physical exertion is no longer a high priority, but where the demand on athletes of all ages to compete at a high level is increasing. An entire industry has developed to afford people the opportunity to exercise to maintain health, appearance, and competitiveness. Gyms are found in nearly every city and town and have a variety of workout machines. Some machines are complicated and can be utilized to exercise a variety of muscle groups, while other machines are designed to exercise specific muscle groups.

Each of the muscles on the exterior of the human body involves a muscle belly. A tendon on each end of the muscle belly is attached to a respective bone. As the muscles flex and extend, they operate the bones as levers. The tendon that attaches one end of a muscle belly to a bone and that remains fixed during flexion is termed the "origin" of the muscle and the tendon that attaches the other end of the muscle to a second bone and moves that bone during flexion is termed the "insertion" of the muscle.

The most common and easily recognized example of these relationships is the biceps brachii, located on the upper arm and attached at two points at the upper arm and scapula and a single lower point on the lower arm slightly past the elbow. The most common exercise for the biceps brachii is the barbell curl (which can be achieved by a dead weight or a machine). A barbell (dead weight) is lifted off the floor with both arms extended and with the body fully vertical, the barbell is curled to a position below the chin as the elbows are held at the sides of the body. The "origin" of the biceps brachii in this exercise is the two-point upper attachment (fixed) while the "insertion" is the lower attachment that moves the lower arm in a pivotal motion from full extension to full flexion to the position below the chin.

Another common exercise for the biceps brachii is the chinning exercise. The arms grasp an overhead bar and the body is pulled up until the chin is positioned over the bar at full flexion. In this exercise, the "origin" and "insertion" are the reverse of the barbell curl exercise. The attachment to the lower arm is the "origin" (fixed) while the two-point attachment at the upper arm and scapula becomes the "insertion" and performs the movement of the entire body to the position where the chin is positioned over the bar.

By changing the position of muscle flexion based upon the "origin" and "insertion" of a muscle, the belly of the muscle becomes more developed and adaptable in strength and coordination.

There has been consideration development during the past fifty years of exercise machines using various pulleys and weights to position a user to isolate and exercise specific muscles in a multitude of different positions.

The present invention is directed to a novel group of workout equipment and to a method to exercise the upper leg muscles, the biceps femoris, commonly referred to as the hamstrings, and also to exercise the quadriceps. The biceps femoris is an upper leg muscle somewhat analogous to the biceps brachii on the upper arm. In a similar manner, the biceps femoris is attached between two points at the upper leg bone and hipbone and a single lower point on the lower leg slightly past the knee.

There are several exercise machines that are well known in which the attachment of the upper leg bone and hipbone is the "origin" and the lower leg bone attachment is the "insertion". For example, U.S. Pat. No. 5,499,962, discloses a sitting position in which the knees are fixed in front and the heels are imposed on a padded roller on a lever that raises a stack of weights as the biceps femoris is flexed to bring the heels close to the buttocks. U.S. Pat. No. 4,575,077, discloses a bench on which the user lies on his stomach with the knees fixed in front and the heels are, again, imposed on a padded roller on a lever that raises a stack of weights as the biceps femoris is flexed to bring the heels close to the buttocks.

Additional examples of machines of this type are the following U.S. Pat. Nos.: 4,468,026; 4,725,056; 5,5058,884; 5,094,450; 5,158,520; 5,334,120; 5,569,133; 5,628,714; 5,634,873; 5,711,749; 5,766,118; 6,059,698; 6,059,701; 6,106,444; 6,296,594; and 6,231,486.

It would desirable to have improved equipment available for use in specifically exercising the upper leg muscles, and to provide techniques to more efficiently exercise such muscles.

It therefore is an object of the present invention to provide equipment and techniques to specifically exercise the upper leg muscles.

The equipment and technique according to the present invention reverses the origin" and "insertion" of the biceps femoris, for example, by fixing the position of the heel to stabilize the lower leg and have the upper leg bone pull the entire upper body to bring the buttocks close to the heel. This results in the biceps femoris attachment to the lower leg bone being the "origin" and the attachment at the upper leg bone and hipbone being the "insertion".

The muscles of the leg are extremely strong. Power lifters have "squatted" over 1000 pounds. However, the main muscle mass performing the squat is the quadriceps muscle on the front of the thighbone. The biceps femoris on the rear of the thighbone acts mainly as a stabilizing muscle during heavy squatting.

It is further object of the present invention to employ in the technique use of the part of the upper body weight as part of the resistance that the biceps femoris muscle must move during full extension to full flexion. This is accomplished by using levers and weights to support part of the upper body weight during movement from full extension to full flexion.

It is still a further object of the present invention to provide an exercise machine for the quadriceps muscle such that an elderly person, a person beginning an exercise program, or a person recovering from a leg injury can perform a squat exercise. Such an exercise machine includes a cable, a stack of weights, and a pivotable seat on which the user can sit while squatting to a parallel position while the weight stack offsetting a portion of the user's body weight.

BRIEF DESCRIPTION OF THE SEVERAL VIEWS OF THE DRAWINGS

The following figures have been selected to illustrate the present invention in its various aspects.

BRIEF SUMMARY OF THE INVENTION

Figure 1:
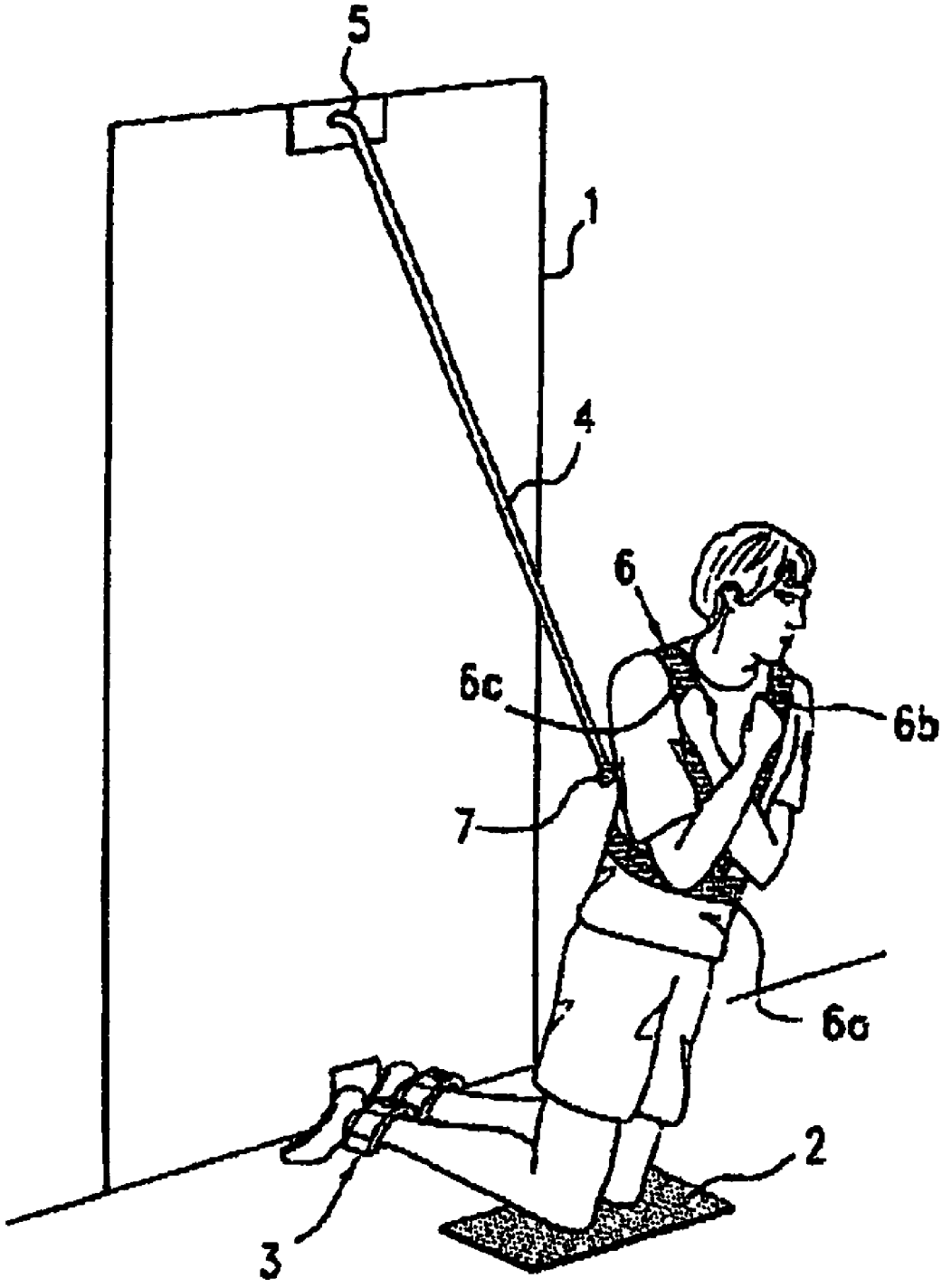
FIG. 1 illustrates apparatus for exercising the hamstrings with the muscle attachment below the knees functioning as the "origin".

Briefly, in accordance with the invention, I provide an improved exercise machine. The machine includes a primary stationary support frame; and, a rocker attached to said primary frame at a first pivot point. The rocker includes a knee rest, a chest rest generally normal to the knee rest, handles attached to the chest rest, a first arm, and a counterbalance weight. The rocker is movable between at least two operative positions, a first upright operative position, and a second operative position with said rocker canted from said first upright position. The exercise machine also includes a footrest, and a secondary weight-bearing frame. The secondary frame includes a second arm, includes a third weight-bearing arm, and is attached to the primary frame at a second pivot point. The first and second arms are pivotally attached such that when the rocker pivots about the first pivot point and the first arm is displaced, the second arm and the secondary frame are simultaneously displaced. The second frame can be shaped and dimensioned such that the third weight bearing arm opposes movement of the rocker from the first to the second operative position, and assists movement of the rocker from the first to the second operative position. The second frame can include a fourth weight bearing arm that assists movement of the rocker from first to second operative position, and opposes movement of said rocker from the second to the first operative position. The rocker can be movable between at least three operative positions including the first and second operative positions and a third operative position in which the rocker is canted at an angle below horizontal.

In another embodiment of the invention, I provide an improved exercise machine. The exercise machine includes a primary stationary support frame; and, a rocker attached to the primary frame at a first pivot point. The rocker includes a knee rest, a chest rest generally normal to the knee rest, handles attached to the chest rest, a first arm, and a counterbalance weight. The rocker is movable between at least three operative positions, a first upright operative position, a second operative position with the rocker canted from the first upright position, and a third operative position with said rocker canted from said first upright position to a position below horizontal. The exercise machine also includes a footrest; and, a secondary weight-bearing frame. The secondary frame includes a second arm; includes a third weight bearing arm that assists movement of the rocker from the first to the second operative position, and opposes movement of the rocker from the second to said first operative position; includes a fourth weight bearing arm that assists movement of the rocker from the first to the second operative position, and opposes movement of the rocker from the second to the first operative position; and, is attached to the primary frame at a second pivot point. The first and second arms are pivotally attached such that when the rocker pivots about the first pivot point and the first arm is displaced, the second arm and the secondary frame are simultaneously displaced.

Turning now to the drawings, which depict the embodiments of the invention for the purpose of illustration thereof and not by way of limitation of the scope of the invention, and in which like reference characters refer to corresponding elements throughout the several views, in FIG. 1 a hamstring exercise using the muscle attachment of the biceps femoris below the knees as the "origin" can be performed with a minimum of equipment in a person's home. This exercise requires a door 1, and the equipment includes a kneepad 2, a set of anchor boots 3 with tips to slide under the door, an elastic band 4 with a door clamp 5, and a body harness 6 with a hook 7 for attachment to the elastic band 4.

DETAILED DESCRIPTION OF THE INVENTION

The harness 6 includes a torso strap 6*a* and two shoulder straps 6*b* and 6*xc*. The shoulder straps 6*b* and 6*c* are connected to the torso strap. The torso strap 6*a* is normally worn at the waist of the user. The two shoulder straps 6*b* and 6*c* and the torso strap 6*a* can each be provided with an adjustment capability, such as would result from the use of a typical buckle arrangement. The hook 7 is attached, preferably, to the torso strap 6*a* on the back of the harness.

The user attaches the elastic band 4 to the top of the door 1 by engaging the clamp 5 with the top of the door 1, and to the back of the harness 6 with any conventional clamp-type device. The user then kneels on the knee pad 2 with the tips of the anchor boots 3 inserted under the door in the position shown. The user leans forward toward a horizontal position (full extension of the biceps femoris) and, from that position, returns his or her body to the original position by flexing the biceps femoris. The strain on the biceps femoris is reduced by the elastic band 4. Band 4 assists the hamstrings.

Figure 3:
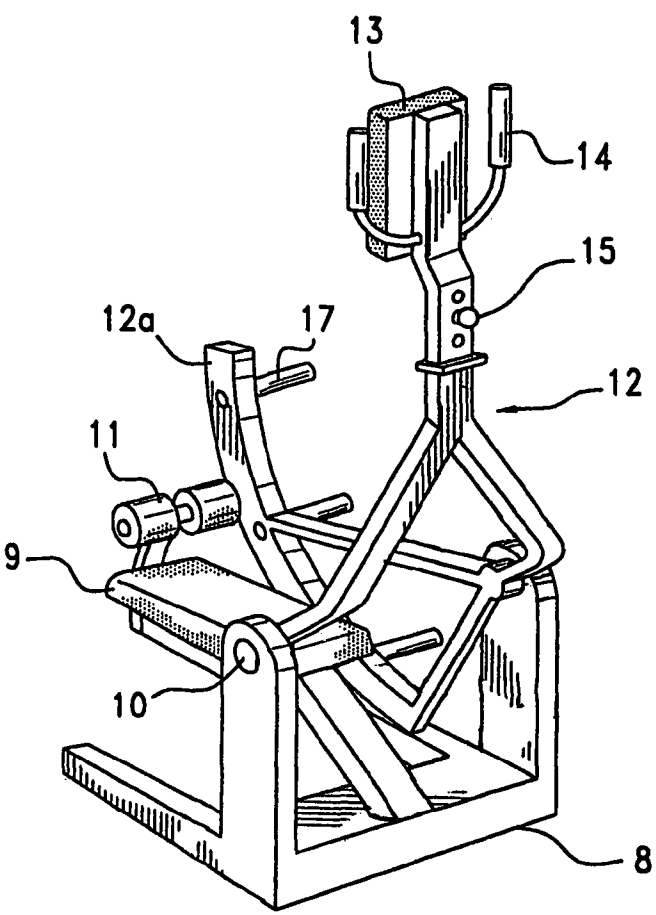
FIG. 3 is a perspective view further illustrating the apparatus shown in FIG. 2.
Figure 2:
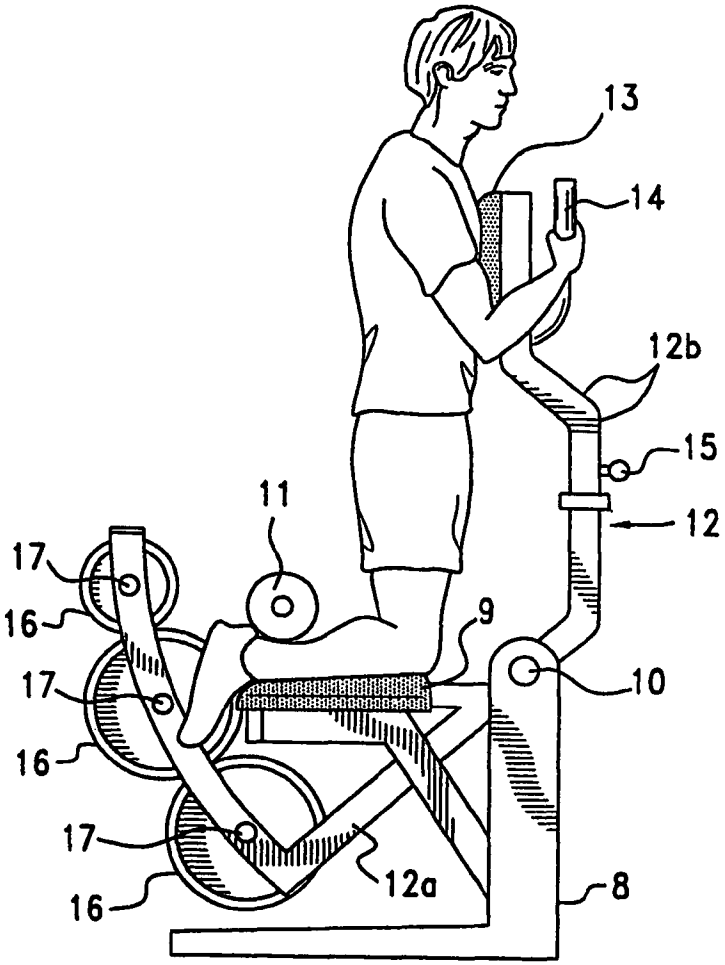
FIG. 2 is illustrates another apparatus to exercising the hamstrings with the muscle attachment below the knees functioning as the "origin". The apparatus uses a pivotable lever with a varying moment arm.

In FIGS. 2 and 3, the hamstring exercise apparatus comprises a stand alone support base with a lever. A generally L-shaped base 8 provides a raised padded kneepad 9, and, on substantially the same plane, a pivot 10. The rear of the kneepad has a raised padded roller 11 under which a user can place his or her ankles. A lever 12 is attached to the pivot and has an upper padded area 13 that can contact a user's chest along with a handle bar 14 on each side of the back of area 13. The lever 12 has a lower rear extending portion 12*a* on which different sized weights 156 can be placed on horizontally extending pins 17. An upper portion 12*b* is adjustable in height, preferably telescopically, relative to the lower rear extending portion 12*a*. After portion 12*b* is adjusted, it is fastened in place by a set screw or locking pin 15.

The user adjusts the chest pad 13 to a desired position, kneels on the pad 89 with his ankles secured under the roller 11, and leans forward toward a horizontal position (full extension of the biceps femoris). After the user reaches a horizontal position, the user returns his or her body to the original position by flexing the biceps femoris. The strain on the biceps femoris is reduced by the weights on the lever.

Figure 4:
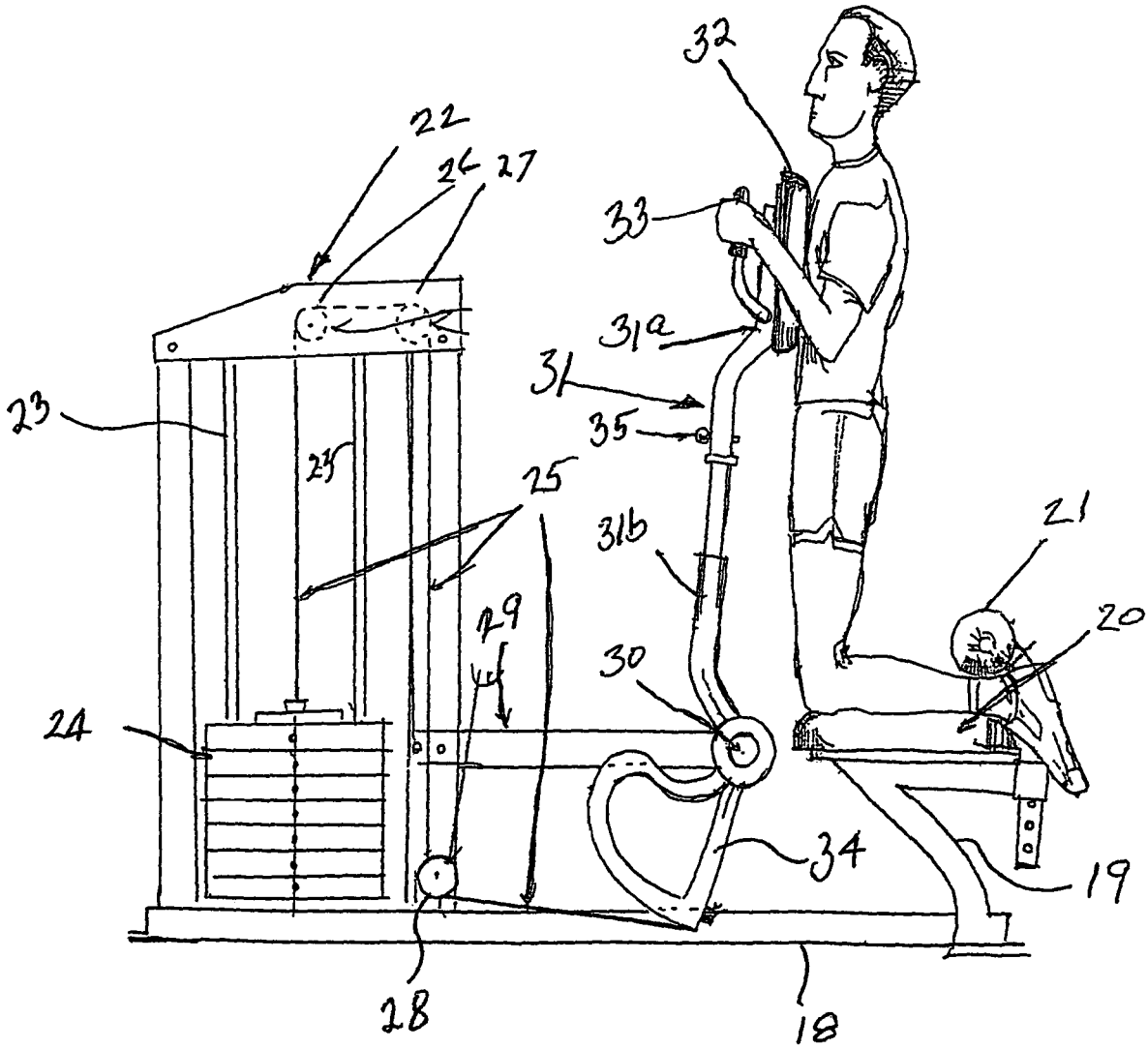
FIG. 4 illustrates a further apparatus for exercising the hamstrings with the muscle attachment below the knees functioning as the "origin". The apparatus of FIG. 4 uses a pivotable lever attached to a cable to raise and lower a stack of selected weights.

In FIG. 4, the hamstring exercise apparatus comprises a stand-alone support base 18 with a lever and cable attached to a weight stack. The support base 18 includes raised portion 19 attached to one end of base 18. A padded kneepad 20 is attached to portion 19. A raised padded roller 21 is attached to the rear of the kneepad 20. The opposite end of support base 18 is connected to a raised framework 22 in which a stack of flat weight plates 24 are slidably selectably mounted on vertically oriented guide rods 23. A cable 25 is attached to the top of the weigh stack and extends over two pulleys 26 and 27 at the top of the framework and down to a pulley 28 at the base of the framework. A horizontal support 29 is rigidly connected to and extends outwardly from the framework 22. Pivot 30 is mounted on the distal end of support 29. Pivot 30 is connected to lever 31.

Lever 31 includes an upper adjustable portion 31*a* having a padded area 32 that contacts a user's chest. Handles 33 are positioned at the back of and on either side of padded area 32. The lower portion 31*b* of lever 31 includes curved portion 34 extending below pivot 30. A portion of cable 25 extends generally horizontally from pulley 28 and is attached to portion 34.

The upper portion 31*a* is adjustable in height similarly to the upper portion 12*b* and is fastened in a selected position with a set screw or pin 35.

The user adjusts the chest pad 32 to a desired position, kneels on the pad 20 with his or her ankles secured under the roller 21, leans forward toward a horizontal position (full extension of the biceps femoris) and, from that position, returns his or her body to the original position by flexing the biceps femoris. The strain on the biceps femoris is reduced by the weights supported on the cable.

Figure 5:
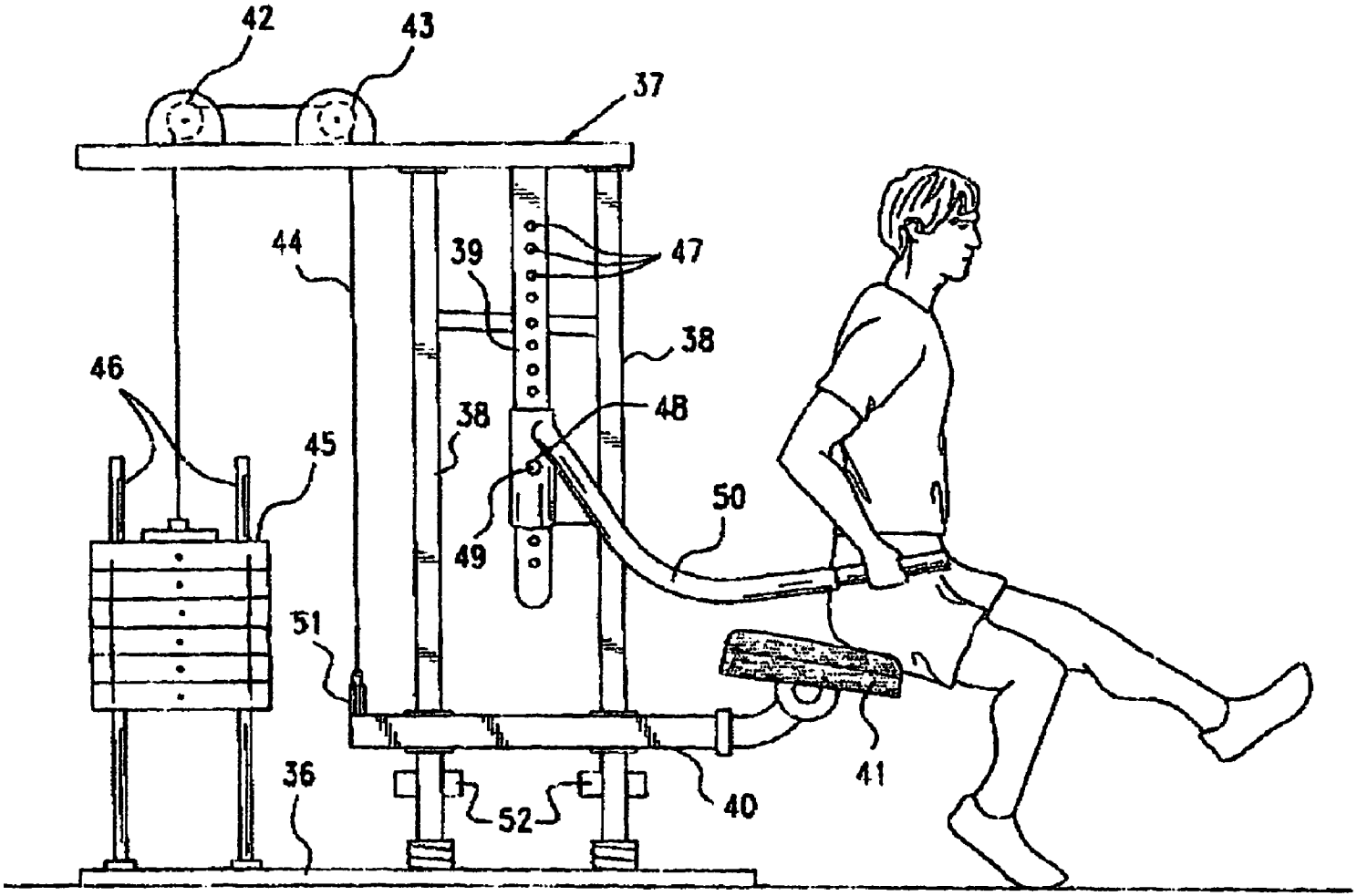
FIG. 5 illustrates still another apparatus to exercise the quadriceps muscles. The apparatus of FIG. 5 utilizes a body weight—offsetting seat that slides up and down on vertical rods.

FIG. 5 is also an exercise apparatus for the upper leg muscles, and comprises a support base 36. Sliding pivotable seat 41 is mounted on base 36. Cable 44 is attached to a weight stack. The support base 36 has an upper horizontally oriented member 37 supported by vertically oriented bars 38. Plate 39 extends downwardly from member 37 between bars 38. Horizontally oriented support 40 is slidably mounted on bars 38. Padded seat 41 is pivotally mounted on the distal end of support 40. Pulleys 42 and 43 are mounted on member. Cable 44 extends over pulleys 42 and 42. One end of cable 44 is attached to the top of selectorized weight stack 45. Weight stack is slidably mounted on vertically oriented guide rods 46. Elongate plate 39 includes apertures 47 extending therethrough. Slide 48 moves up and down along plate 39 to a selected position in which an aperture in slide 48 is in registration with a selected aperture 47, after which pin 49 is inserted through the aperture in slide 48 and through the selected aperture 47 to secure slide 48 and handle bar(s) 50 in position. Pin 51 on support 40 attaches one end of cable 44 to support 40.

The user positions a stop 52 on each of the vertical bars 38 so that during use of the exercise apparatus of FIG. 5, member 40 will not slide downwardly along bars 38 below a point that will cause the user's thighs to move below parallel to the ground. The user selects one or more weights in stack 45, and assumes the position illustrated in FIG. 5 with one or neither leg extended. The user then slowly lowers his body (along with member 40) a desired distance, pauses, and uses his legs to move his body upwardly a selected distance. Weights 45 and cable 44 function to upwardly slidably displace member 40 along vertically oriented bars 38. This squat exercise can be performed with one or two legs, depending on the amount of weight selected on weight stack 45 to assist and offset the user's body weight. The exercise can also be performed with both legs extended such that the user's arms and upper body lower and lift the user.

The four apparatuses described above are useful in rehabilitating and developing the hamstring and quad muscles of the legs of a user.

Figure 6A:
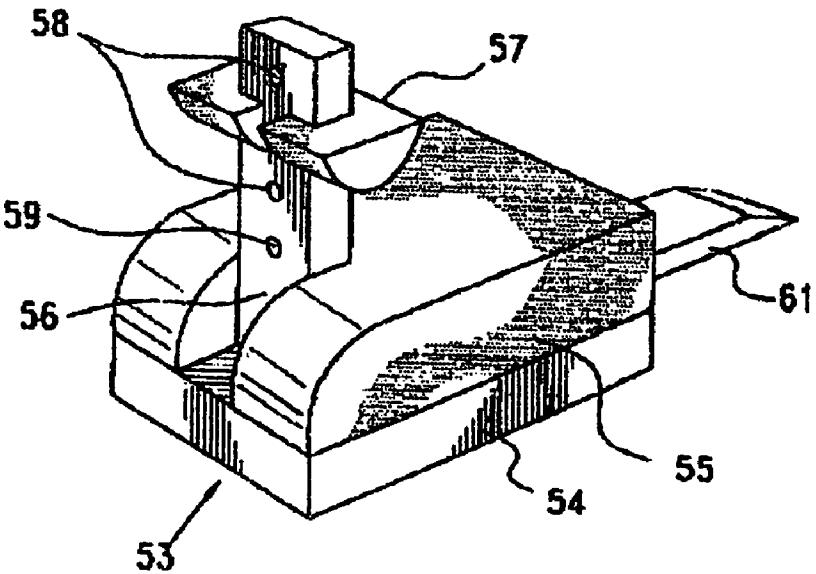
FIGS. 6*a* and 6*b* illustrate a simple apparatus on which an individual kneels while pivoting his or her upper body down and up.
Figure 6B:
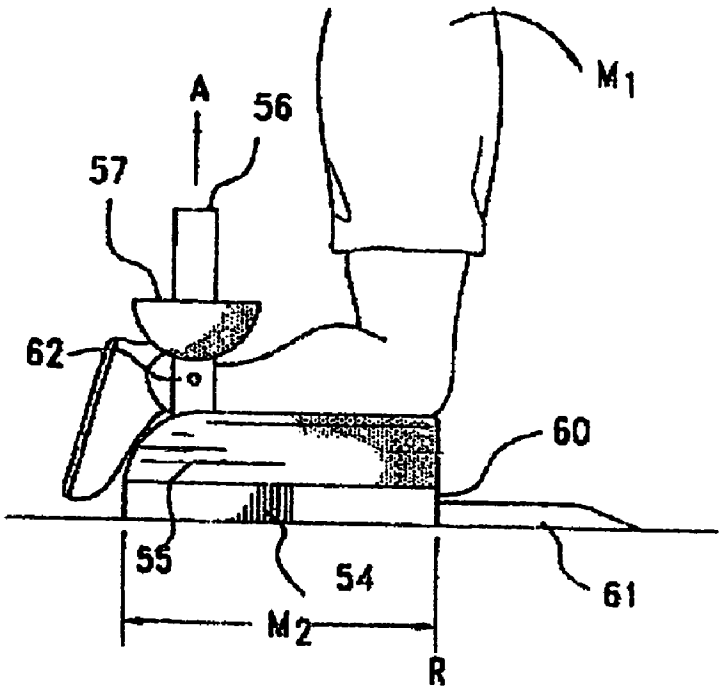

FIGS. 6*a* and 6*b* illustrate a stand along apparatus including a base structure 54. Pad 55 is attached to structure 54. Post 56 extends from one end of the base structure 54. Cushion 57 is slidably mounted on post 56. The post 56 includes a plurality of spaced holes 58 to slidably, removably receive a pin 59 to secure cushion 57 at a desired location on post 56. Balance bean 61 is slidably mounted in opening 60 at the front of base structure 54.

In use, an individual kneels as shown in FIG. 6*b* on the pad 55 with his or her ankles 62 below and against the cushion 57. The balance bean 61 has been extended outwardly from the base structure 54 a distance sufficient to prevent structure 54 from tipping upwardly off the ground when an individual kneeling on cushion 57 leans forward.

Figure 7:
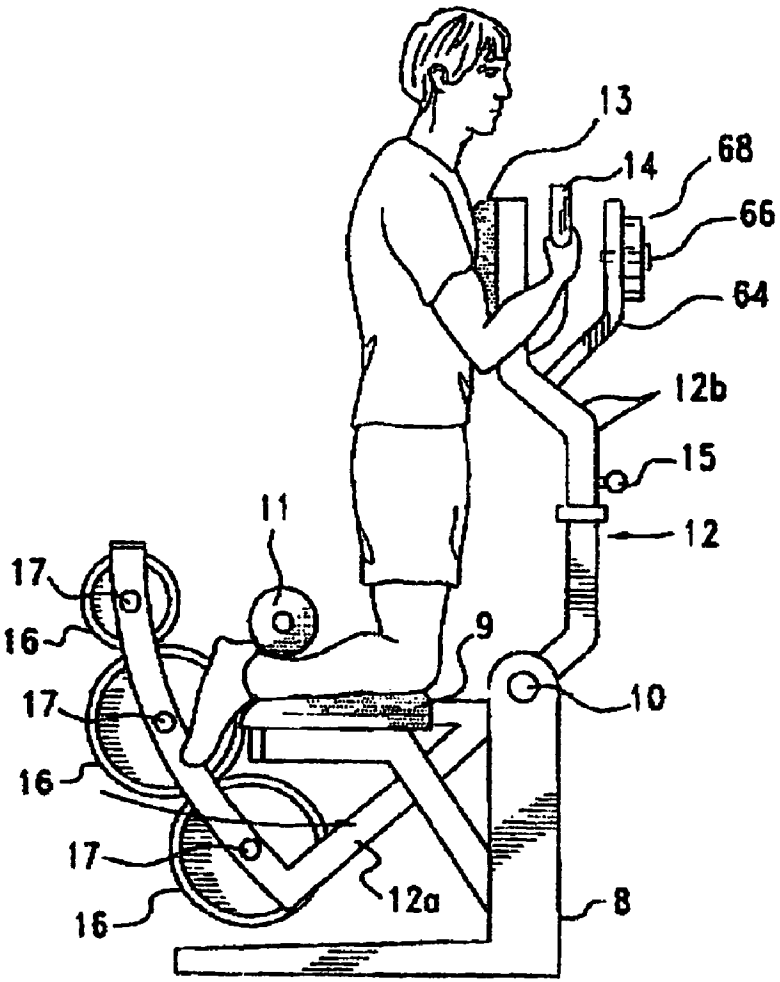
FIG. 7 is a side view illustrating an alternate embodiment of the invention.

FIG. 7 illustrates the exercise machine of FIG. 2 with member 64 affixed thereto. Pin 66 supports weight 68 on member 64. Member 64 can include multiple spaced apart pins 66 to support a plurality of weights.

FIGS. 8 to 11 illustrate an exercise machine 70 constructed in accordance with an alternate embodiment of the invention and including a primary substantially rigid fixed stationary support frame 80, a rocker 71, and a secondary weight-bearing frame 72.

Rocker 71 includes a rigid frame including interconnected arms 76, 77, 78. Counterweight 89 is fixedly secured to the distal end of arm 77. Arm 77 is pivotally attached by pin 100 to cross-member 82 of the primary stationary support frame. A chest rest mounted on the distal end of arm 76 includes I-shaped support plate 75 and a cushion (not shown in FIG. 8) mounted on plate comparable to cushion 75A in FIG. 12. A knee rest is fixedly secured to and extends outwardly from and normal to arm 77. The knee rest includes rectangular support plate 90 and a cushion (not shown in FIG. 8) mounted on plate 90 and comparable to cushion 90A in FIG. 12. Plates 75 and 90, arms 76-78, and counterweight 89 comprise a substantially rigid interconnected unit and pivot simultaneously about pin 100.

Figure 8:
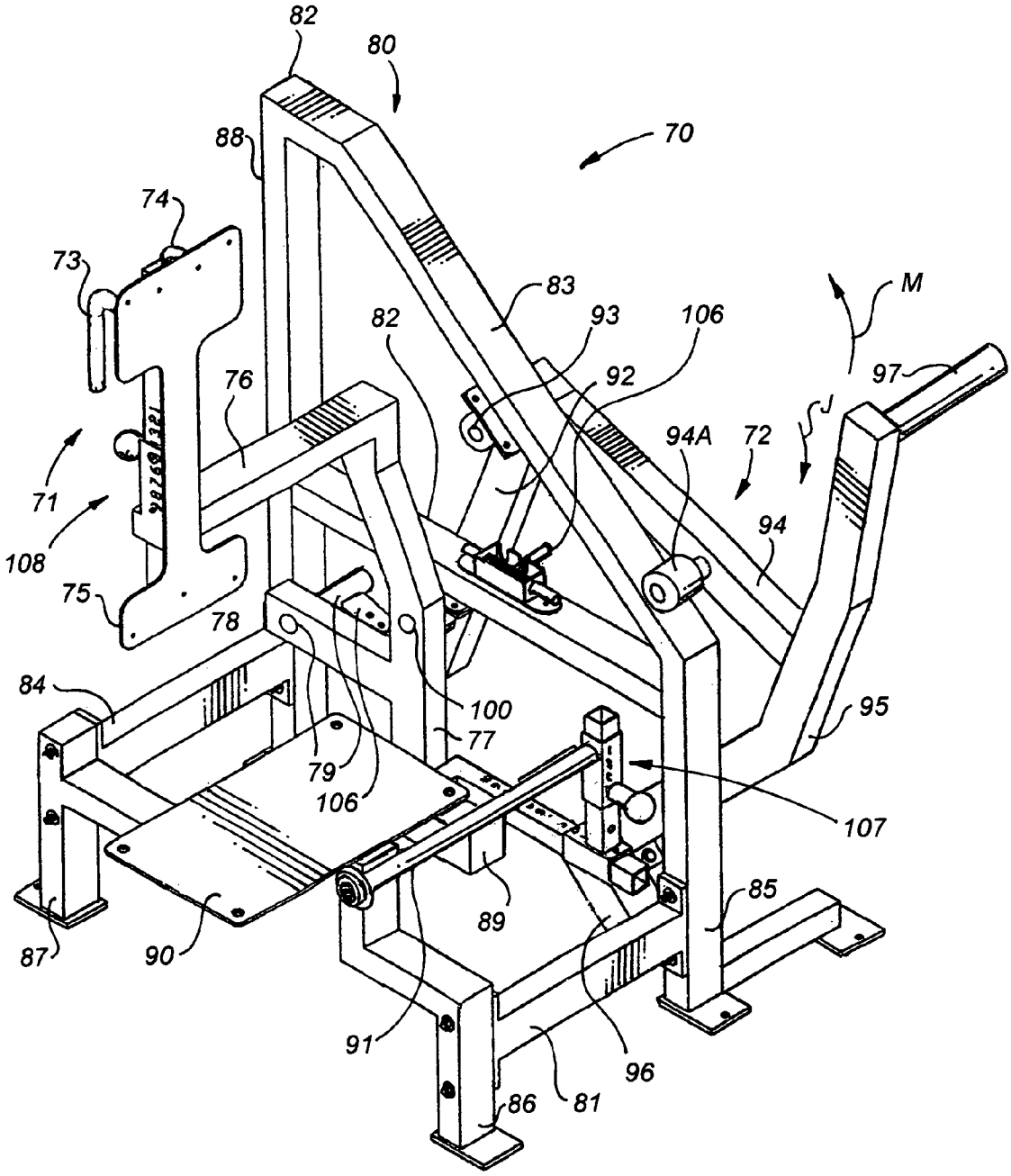
FIG. 8 is a perspective view illustrating still another embodiment of the invention.
Figure 9:
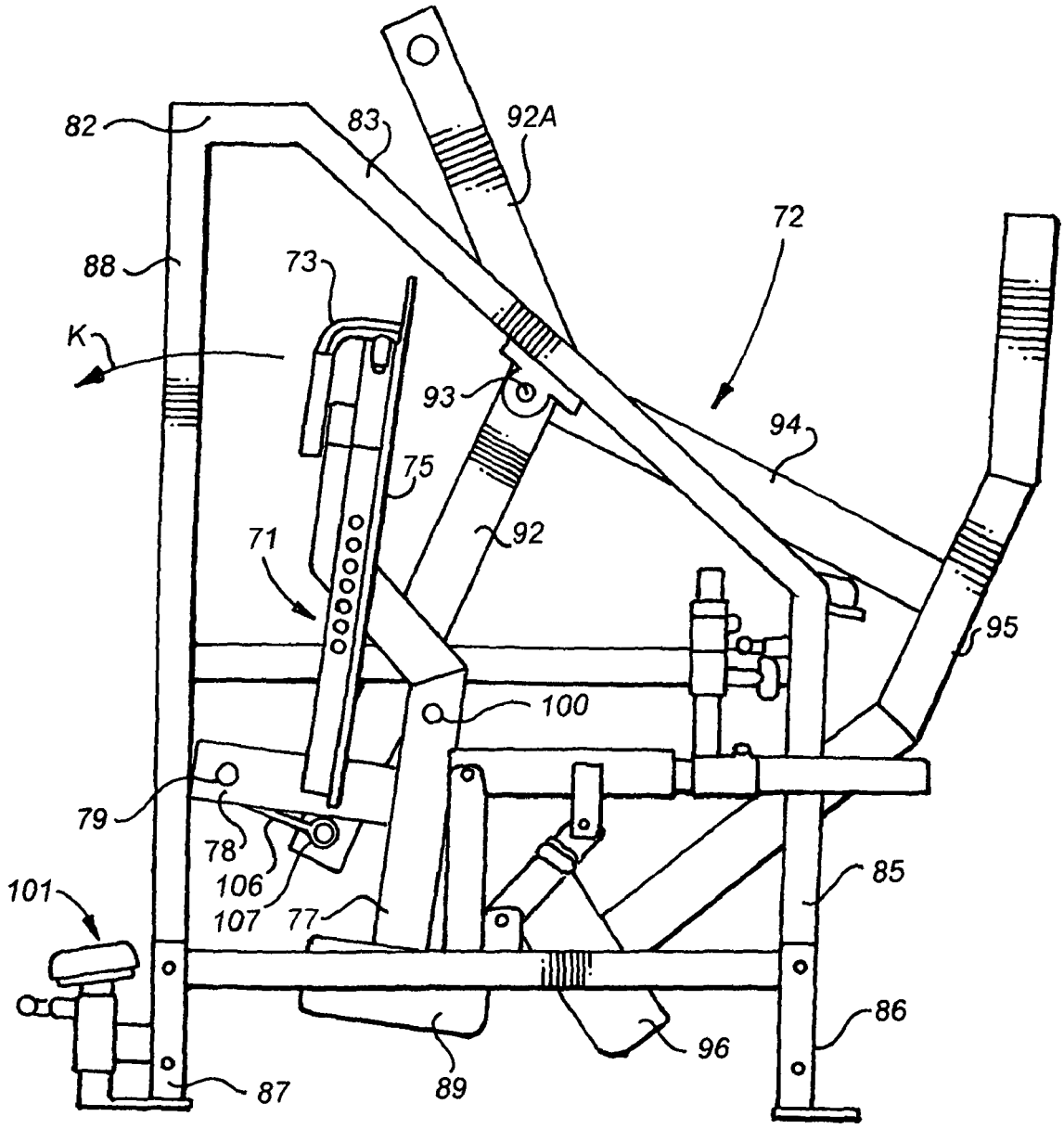
FIG. 9 is a left hand side view illustrating an exercise machine substantially identical to the exercise machine of FIG. 8.
Figure 10:
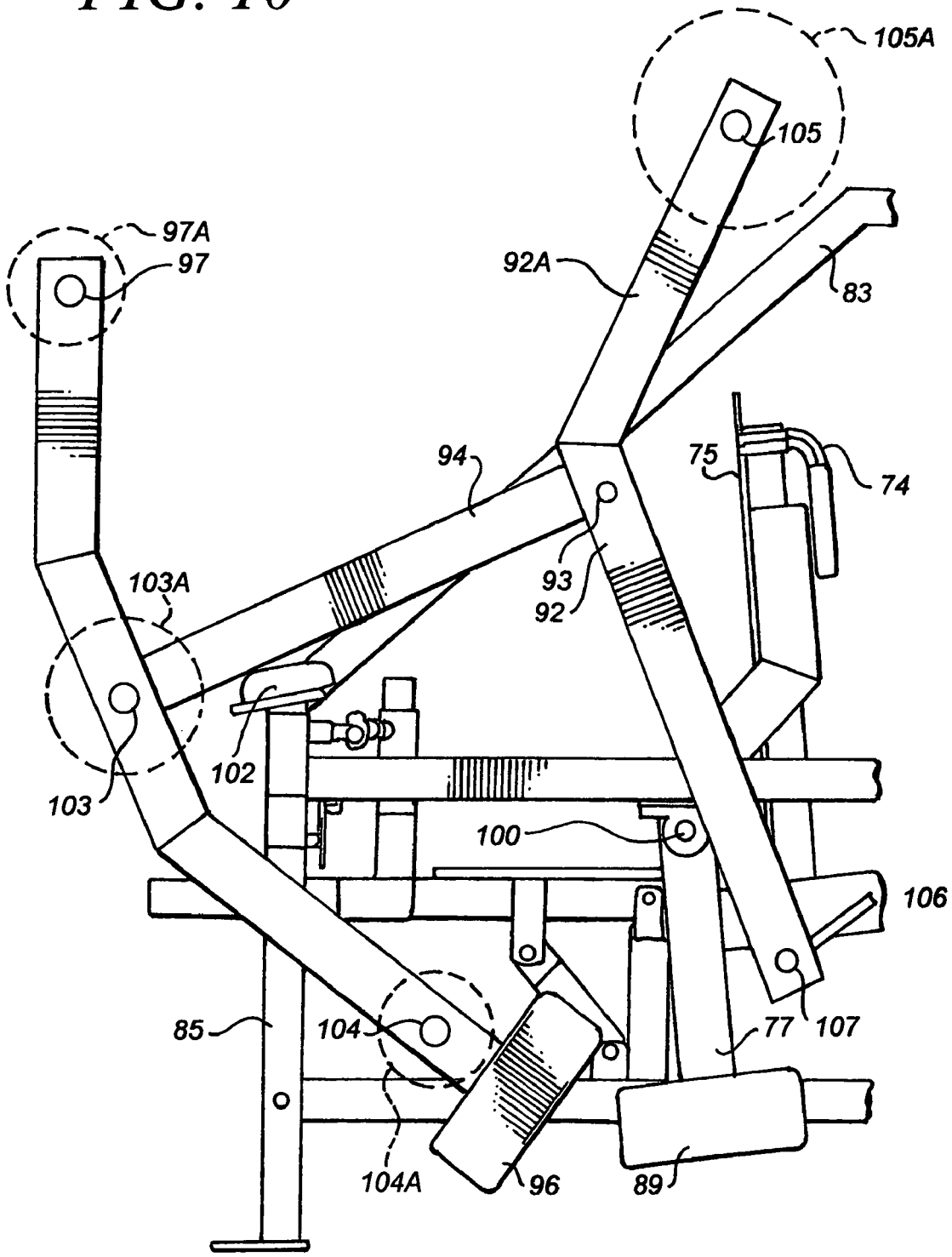
FIG. 10 is a right hand side view illustrating an exercise machine substantially identical to the exercise machine of FIG. 8.
Figure 11:
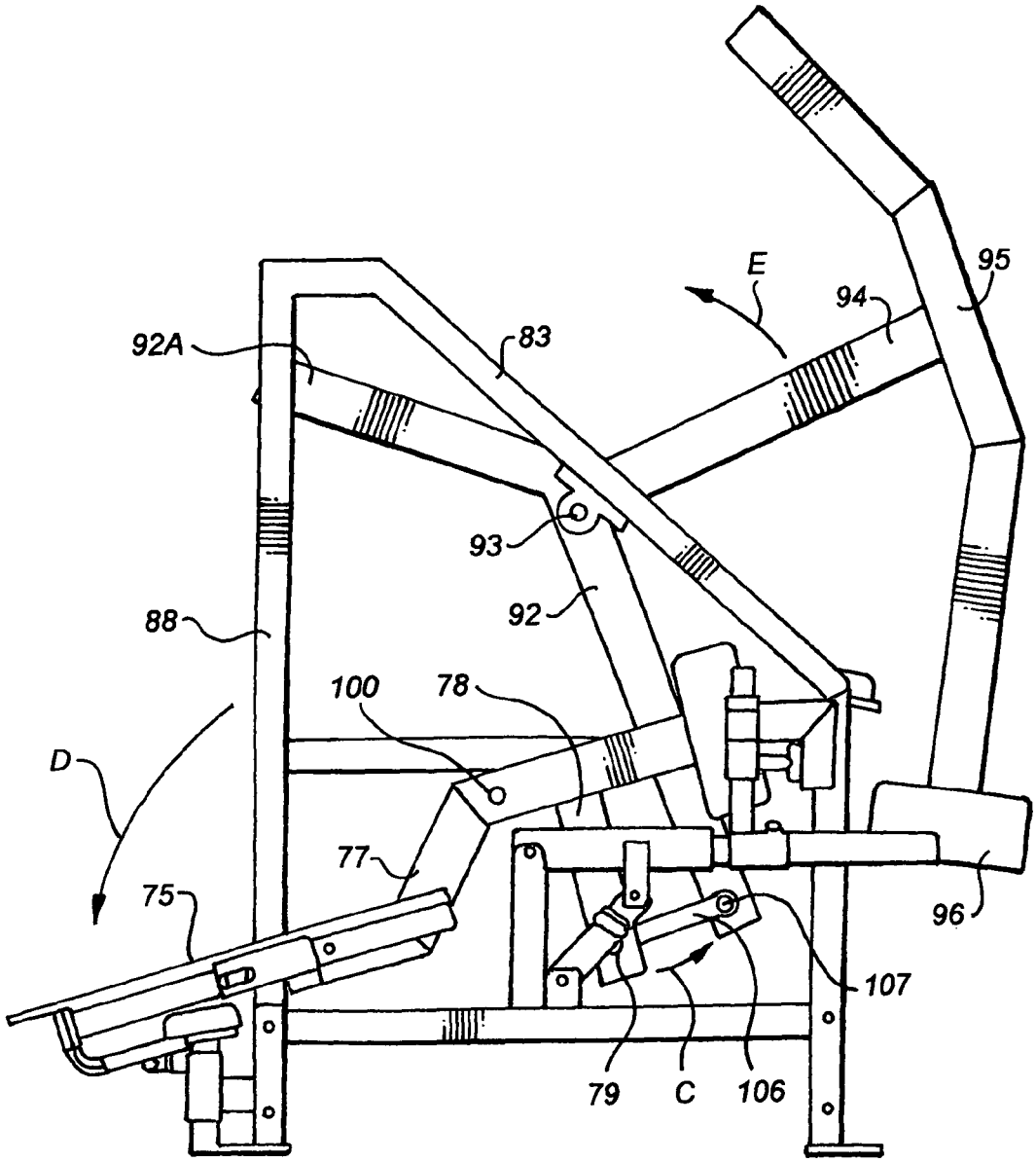
FIG. 11 is a left hand side view of the exercise machine of FIGS. 9 and 10 illustrating the mode of operation thereof.

The primary fixed substantially rigid support frame 80 includes vertically oriented legs 86, 87, 85, 88, includes horizontally oriented cross-member 84 interconnecting legs 87 and 88, includes horizontally oriented cross-member 81 interconnecting legs 85 and 86, includes cross-members 82 and 83 interconnecting legs 85 and 88, and, includes horizontally oriented cross-member 82 interconnecting legs 85 and 88. Frame 80 can also optionally include, as illustrated in FIGS. 9 to 11, a stop 101 for halting the pivotal downward movement of rocker 71 in the manner illustrated in FIG. 14. Further, frame 80 can also optionally include a stop 102 for halting the downward movement of arm 94 of secondary frame 72. In place of stop 102, a roller 94A can be mounted on arm 94 and function to contact arm 83 to halt the downward movement of arm 94 in the direction of arrow J in FIG. 8. A footrest is mounted on frame 80 and includes cylindrical roller 91A mounted on shaft 91 (FIGS. 8, 13). FIG. 8 illustrates slidable adjustments 107 including quick release pins that can be utilized to horizontally and vertically adjust the position of the footrest. Similarly, FIG. 8 illustrates a slidable adjustment 108, including a quick release pin that can be utilized to vertically adjust the position of plate 75 (and of the cushion 75A mounted on plate 75) on the rocker 71. During use of the exercise machine of FIG. 8, a user's ankles are positioned beneath and against the footrest roller in the manner illustrated in FIGS. 12 to 14.

The secondary weight bearing frame 72 is substantially rigid and includes interconnected arms 92, 94, 95; includes counterweight 96 fixedly secured to the lower end of arm 95; and includes outwardly extending horizontally oriented rods 97 (FIG. 8), 103 (FIG. 10), 104 (FIG. 10) on which cylindrical weights 97A, 103A, 104A, 105A can be slidably, removably mounted. Each weight 97A, 103A, etc. has a cylindrical aperture formed through the center of the weight. These cylindrical apertures are sized to slide over a rod 97, 103, 104. Arm 92 is pivotally secured to arm 83 by pin 93. The distal end of arm 92 is secured to the distal end of arm 78 by a linkage assembly that includes link 106. One end of link 106 pivots about a pin 107 in arm 92. The other end of link 106 pivots about a pin 79 in arm 78.

The linkage assembly permits arm 78 to displace arm 92 (and to consequently displace the entire secondary frame 72 pivotally about pin 93) when the rocker 71 is pivotally displaced about pin 100.

Further, although pivoting link 106 maintains a constant distance between pins 79 and 107 when the rocker 71 and secondary frame 72 are moving, link 106 also permits the relative position of the distal end of arm 92 and the distal end of arm 78 to vary with respect to one another. This variation in the relative positions of the ends of arms 78 and 92 can be seen in FIG. 10, where the rocker is upright, and in FIG. 11, where the rocker is horizontally oriented. In FIG. 10, the end of arm 78 is above the end of arm 92. In FIG. 11, in contrast, the end arm 92 is above the end of arm 78.

Any linkage assembly other than the linkage assembly including link 106 can be utilized to interconnect arms 92 and 78 and function in the manner described above in connection with link 106.

Secondary frame 72 can include an additional arm 92A including a horizontally oriented rod 105 to receive slidably removably one or more weights 105A. The function of arm 92A and weights 105A is to (1) provide resistance when an individual attempts to move the rocker 71 upwardly in the direction of arrow L (FIG. 12) from one of the canted operative positions illustrated in FIGS. 11, 12, 14 back to a more upright position illustrated in FIGS. 8, 9, 10, 13, and (2) provide assistance when an individual attempts to move the rocker in the direction of arrow K (FIG. 9) from a more upright operative position in the direction of arrow K (FIG. 9) to a more canted operative position. In contrast, when weights are on rods 97, 103, 104 on secondary frame 72, these weights function to (1) oppose movement of rocker 71 downwardly in the direction of arrow K (FIG. 9) from an upright operative position of the type illustrated in FIGS. 8, 9, 10, 13 to a more canted operative position of the type illustrated in FIGS. 11, 12, 14, and (2) assist movement of rocker 71 from a canted operative position in the direction of arrow L (FIG. 12) to a more upright operative position. Accordingly, as can be appreciated by those of skill in the art, weights positioned on rod 105 tend to offset or oppose forces generated by weights placed on rods 97, 103, 104. Weights on rods 97, 103, 104 on secondary frame 72 and counterbalance weights 89, 96 are important because these weights function to offset the weight of an individual positioned on rocker 71 in the manner illustrated in FIG. 13 and, when the total mass of the weights is sufficient, to prevent the individual's weight from causing the rocker 71 to rapidly move downwardly in the direction of arrow K (FIG. 9) from an upright operative position of the type illustrated in FIGS. 8, 9, 10, 13 to a more canted operative position of the type illustrated in FIGS. 11, 12, 14, The exercise apparatus of FIG. 8 can be provided with a stop 106 on cross-member 82 which, when rocker 71 is pivoted downwardly in the direction of arrow K (FIG. 9) from the upright position of FIG. 8, is contacted by arm 92 and halts the pivotal movement of secondary frame 72 in the direction of arrow M (FIG. 8). When the movement of frame 72 is halted, the movement of rocker 71 in the direction of arrow K is also halted. Accordingly, such a stop 106 can permit the downward pivoting movement of rocker 71 to be stopped in the position illustrated in FIG. 12, such that plate 75 is prevented from moving any further in the direction of arrow G. In contrast, the embodiment of the invention illustrated in FIGS. 13 and 14 does not utilize a stop 106, but instead utilizes a stop 101 that permits the rocker 71 to pivot such that plate 75 and cushion 75A move past horizontal to a downwardly canted position. This downwardly canted position makes it all the more difficult for an individual to utilize his hamstrings to right himself and plate 75 from the position illustrated in FIG. 14 to the position illustrated in FIG. 13.

Figure 13:
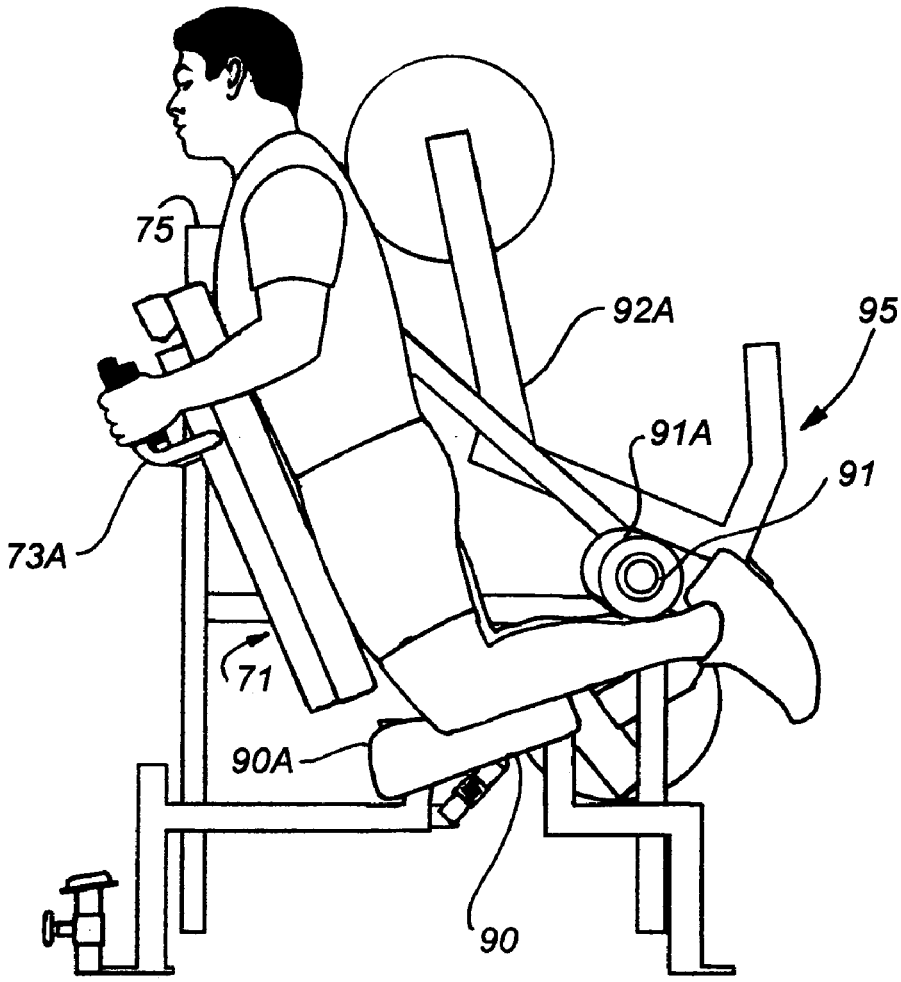
FIG. 13 is a left hand side view of an exercise machine substantially identical to the machine of FIG. 8 and further illustrating the mode of operation thereof.
Figure 14:
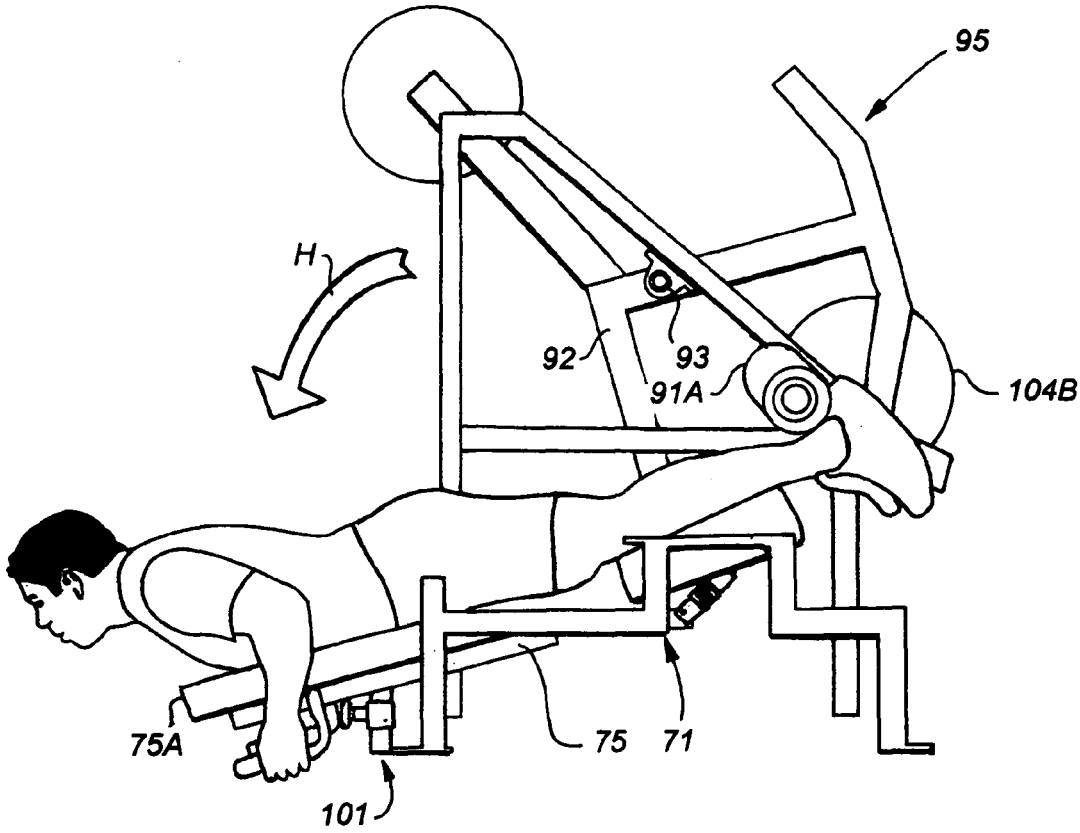
FIG. 14 is a left hand side view of the exercise machine of FIGS. 12 and 13 and further illustrating the mode of operation thereof.

As can be seen in FIG. 13, plate 90 and cushion 90A can, if desired, be positioned in a canted position to facilitate the downward movement of rocker 71 to the downwardly canted position depicted in FIG. 14. If desired, plate 90 and cushion 90A can be adjustably mounted on rocker 71 to facilitate movement of plate 90 and cushion 90A between the horizontally oriented position of FIG. 8 and the canted position of FIG. 13.

Figure 12:
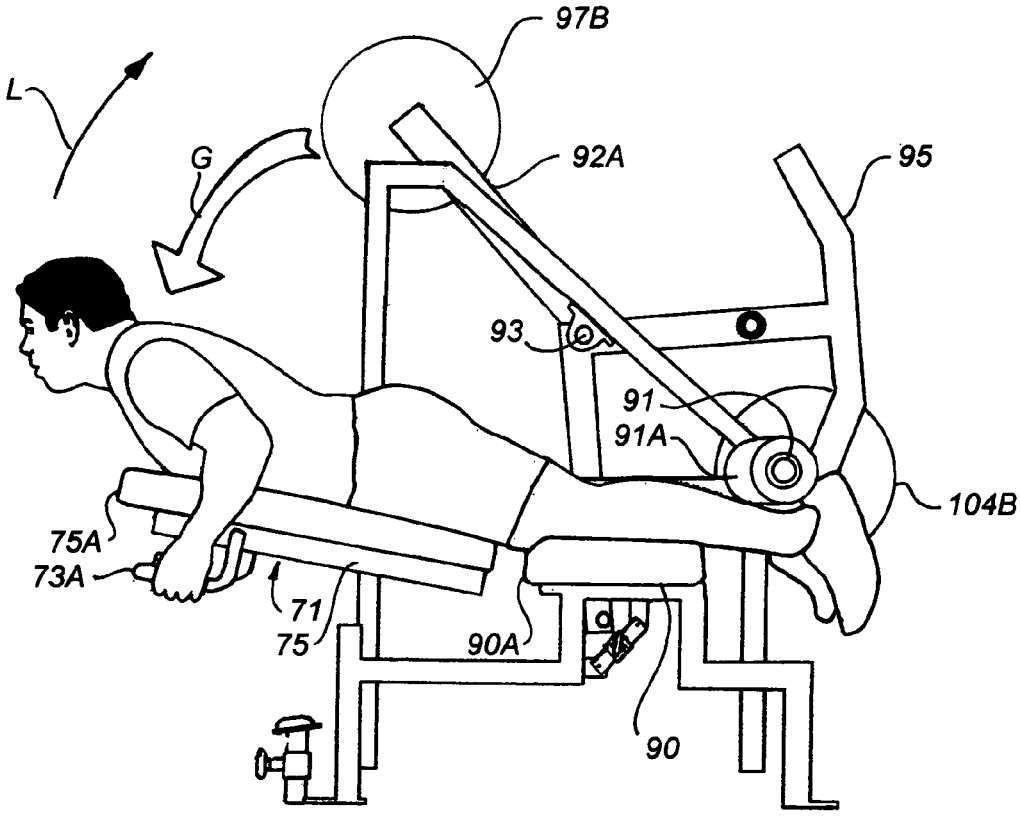
FIG. 12 is a left hand side view of an exercise machine substantially identical to the machine of FIG. 8 and illustrating the mode of operation thereof.

In use of the apparatus of FIGS. 8 to 11, a user places desired weights on rod(s) 97, 103, 104, 105, assumes a starting position comparable to that shown in FIG. 13 (although, the cushion 90A may, as noted earlier, be horizontally oriented instead of being canted in the manner shown in FIG. 13), uses his or her body to tilt rocker 71 in the direction of arrow G or H to the canted position comparable or identical to the positions illustrated in FIGS. 12 and 14, and then uses his legs muscles and body to raise himself upwardly from the canted position back to the more upright starting position.

Having described my invention and the presently preferred embodiments thereof in such terms to enable one of the ordinary skill in the art to practice the invention, I claim:

1. An exercise machine (70) including (a) a primary stationary support frame;

(b) a rocker attached to said primary frame at a first pivot point and including (i) a knee rest, (ii) a chest rest generally normal to said knee rest (iii) handles, (iv) a first arm , and (v) a counterbalance weight, said rocker movable between at least three operative positions, (vi) a first upright operative position, (vii) a second operative position with said rocker canted from said first upright position, and (viii) a third operative position with said rocker canted from said first upright position to a position below horizontal;

(c) a foot rest; and (d) a secondary weight bearing frame (i) including a second arm, (ii) including a third weight bearing arm that opposes movement of said rocker from said first to said second operative position, and assists movement of said rocker from said second to said first operative position, (iii) including a fourth weight bearing arm that assists movement of said rocker from said first to said second operative position, and opposes movement of said rocker from said second to said first operative position, and (iv) attached to said primary frame at a second pivot point spaced apart from said first pivot point, said first and second arms pivotally attached such that when said rocker pivots about said first pivot point and said first arm is displaced, said second arm and said secondary frame are simultaneously displaced.

* * * * *